US008365435B2

(12) United States Patent
Poy et al.

(10) Patent No.: US 8,365,435 B2
(45) Date of Patent: Feb. 5, 2013

(54) LAUNDRY PRESS APPARATUS AND METHOD

(75) Inventors: Russell H. Poy, New Orleans, LA (US); Santhi Antarikananda, Gretna, LA (US)

(73) Assignee: Pellerin Milnor Corporation, Kenner, LA (US)

( * ) Notice: Subject to any disclaimer, the term of this patent is extended or adjusted under 35 U.S.C. 154(b) by 443 days.

(21) Appl. No.: 12/813,324

(22) Filed: Jun. 10, 2010

(65) Prior Publication Data

US 2010/0313440 A1 Dec. 16, 2010

Related U.S. Application Data

(60) Provisional application No. 61/185,699, filed on Jun. 10, 2009.

(51) Int. Cl.
*F26B 5/14* (2006.01)

(52) U.S. Cl. ..... 34/398; 34/413; 34/143; 34/595; 34/610; 68/12.02; 68/12.06; 8/159

(58) Field of Classification Search ..... 34/380, 34/381, 398, 413, 498, 80, 90, 143, 595, 34/601, 610; 68/12.06, 12.02, 5 R, 17 R; 8/158, 159

See application file for complete search history.

(56) References Cited

U.S. PATENT DOCUMENTS

| | | | | | |
|---|---|---|---|---|---|
| 1,359,745 | A | | 11/1920 | Reilly | |
| 1,682,473 | A | * | 8/1928 | Bercaw | 68/148 |
| 1,893,190 | A | | 1/1933 | West | |
| 2,142,202 | A | | 1/1939 | McKay | |
| 2,531,890 | A | | 11/1950 | Pearson | |
| 2,686,373 | A | * | 8/1954 | Erickson | 34/75 |
| 2,720,037 | A | * | 10/1955 | Erickson | 34/526 |
| RE24,257 | E | | 12/1956 | Kahn | |
| 2,941,308 | A | * | 6/1960 | Cobb et al. | 34/552 |
| 2,975,902 | A | * | 3/1961 | Pinder | 68/12.06 |
| 2,985,966 | A | * | 5/1961 | Martin | 34/75 |
| 3,023,514 | A | * | 3/1962 | Gibson | 34/589 |
| 3,071,878 | A | | 1/1963 | Beasley | |
| 3,152,462 | A | * | 10/1964 | Elliott et al. | 68/12.02 |
| 3,269,157 | A | * | 8/1966 | Ashley | 68/242 |
| 3,613,513 | A | * | 10/1971 | Johnson | 92/48 |
| 3,672,188 | A | * | 6/1972 | Geschka et al. | 68/12.15 |
| 3,908,413 | A | | 9/1975 | Meyer | |
| 3,924,425 | A | | 12/1975 | Arendt | |
| 4,180,995 | A | | 1/1980 | Meyer | |
| 4,193,750 | A | * | 3/1980 | Nielson | 425/60 |
| 4,356,711 | A | | 11/1982 | Okazaki | |
| 4,411,664 | A | * | 10/1983 | Rickard et al. | 8/158 |
| 4,452,056 | A | | 6/1984 | Files | |
| 4,471,637 | A | | 9/1984 | Holzinger | |
| 4,525,935 | A | | 7/1985 | Stuhmeier et al. | |
| 4,574,599 | A | | 3/1986 | Pellerin | |
| 4,676,079 | A | | 6/1987 | Czauderna | |
| 4,753,089 | A | | 6/1988 | Engel | |

(Continued)

*Primary Examiner* — Stephen M. Gravini
(74) *Attorney, Agent, or Firm* — Garvey, Smith, Nehrbass & North, L.L.C.; Charles C. Garvey, Jr.; Vanessa M. D'Souza

(57) ABSTRACT

A method and apparatus for pressing fluid from laundry articles employs a receiving vessel that holds a batch of articles that are wetted with fluid. Fabric articles are compressed with a press to discharge fluid from the articles. The press includes a diaphragm that can be pressured with fluid. The diaphragm flexibly conforms to an upper surface portion of the batch of fabric articles. After the fabric articles are pressed of fluid, the diaphragm elevates with the press and is rotated. A specially configured linkage rotates the diaphragm and the press as the diaphragm moves from a lower position to an upper position.

24 Claims, 8 Drawing Sheets

U.S. PATENT DOCUMENTS 4,848,106 A 7/1989 Hayashi et al.
5,001,911 A 3/1991 Eck et al.
5,065,535 A 11/1991 Gill et al.
5,181,398 A 1/1993 Tanaka et al.
5,331,755 A 7/1994 Kwok
5,576,620 A * 11/1996 Cheong ..... 324/174
5,596,889 A * 1/1997 Guerra et al. ..... 68/12.02
5,857,362 A * 1/1999 Oh et al. ..... 68/27
5,930,855 A * 8/1999 Vande Haar et al. ..... 8/159
5,970,637 A 10/1999 Mohan et al.
6,029,300 A * 2/2000 Kawaguchi et al. ..... 8/159
8,176,655 B2 * 5/2012 Gibson ..... 34/558
2009/0230200 A1 * 9/2009 Kempf et al. ..... 236/12.11
2010/0313440 A1 * 12/2010 Poy et al. ..... 34/398
2011/0167662 A1 * 7/2011 Dittmer et al. ..... 34/82

* cited by examiner

LAUNDRY PRESS APPARATUS AND METHOD

CROSS-REFERENCE TO RELATED APPLICATIONS

Priority of U.S. Provisional Patent Application Ser. No. 61/185,699, filed 10 Jun. 2009, incorporated herein by reference, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to a method and apparatus for pressing fluid (e.g. rinse water) from fabric articles (e.g. laundry). More particularly, the present invention relates to a method and apparatus for pressing fluid from laundry articles wherein the press includes a diaphragm that is subjected to pressure (e.g. fluid pressure), so that it flexibly conforms to an upper surface portion of a batch of laundry articles or fabric articles and wherein after each batch of laundry articles or fabric articles have been pressed, the diaphragm is rotated after an upward movement of the press that spaces the diaphragm from the fabric articles.

2. General Background of the Invention

Commercial laundry presses often employ a press having a diaphragm that is pressured with a fluid. The diaphragm flexibly conforms to the upper surface portion of the fabric articles or laundry articles to be pressed so that fluid which wets the fabric articles can be squeezed from the laundry articles.

A problem exists with such a diaphragm press device. If the clothing are discharged from a tunnel washer or other commercial washing device, they often pile in a random orientation with peaks and valleys. One section or portion of the diaphragm is thus subjected to greater stress and resulting wear when compared to other areas of the diaphragm.

The following patents relate generally to laundry presses and like devices.

TABLE

| PATENT NO. | TITLE | ISSUE DATE MM-DD-YYYY |
|---|---|---|
| 1,359,745 | Ironing Machine | Nov. 23, 1920 |
| 1,893,190 | Ironing Machine | Jan. 03, 1933 |
| 2,142,202 | Ironing and Pressing Machine | Jan. 03, 1939 |
| 2,531,890 | Indexing and Lock Mechanism | Nov. 28, 1950 |
| RE 24,257 | Combined Washing and Squeeze Drying Machine | Dec. 18, 1956 |
| 3,071,878 | Ironing Machine | Jan. 08, 1963 |
| 3,908,413 | Pressing Apparatus for the Pressure Extracting of Liquid | Sept. 30, 1975 |
| 3,924,425 | Presses for Washing | Dec. 09, 1975 |
| 4,180,995 | Pressing Apparatus for Squeezing Laundry and the Like | Jan. 01, 1980 |
| 4,452,056 | Liquid Extracting Apparatus | June 05, 1984 |
| 4,471,637 | Apparatus for Dewatering Items of Washed Laundry | Sept. 18, 1984 |
| 4,525,935 | Method for Dewatering Items of Washed Laundry | July 02, 1985 |
| 4,574,599 | Apparatus for Pressing Liquid from Cloth Goods | Mar. 11, 1986 |
| 4,676,079 | Appliance for Draining Washed Laundry Articles | June 30, 1987 |
| 4,753,089 | Water-Removal Press for Textiles | June 28, 1988 |
| 5,001,911 | Ram Press for Expressing Liquid from Materials Being Pressed | Mar. 26, 1991 |
| 5,065,535 | Indexing System for Rotary Garment Press | Nov. 19, 1991 |
| 5,331,755 | Ironing Press with Horizontally Rotatable Pressing Members | July 26, 1994 |
| 5,970,637 | Automatic Shirt Pressing Apparatus Including a Vacuum System and Associated Method | Oct. 26, 1999 |

BRIEF SUMMARY OF THE INVENTION

The present invention provides a method and apparatus for pressing fluid from laundry articles or fabric articles. The method includes filling a receiving vessel, receptacle or "can" with a batch of wetted fabric or laundry articles. These articles have been wetted with fluid such as rinse water as part of a commercial wash cycle.

The fabric articles are pressed with a press that discharges the fluid (e.g. rinse water) from the articles. The press includes a diaphragm that flexibly conforms to an upper surface portion of the batch of fabric articles. The diaphragm is pressurized. Hydraulic pressure on the diaphragm applies great force to the batch of laundry to expel rinse water therefrom.

After the pressing of water from the fabric articles, the diaphragm elevates to a raised position. The diaphragm is rotated after it is spaced away from the batch of laundry. Rotation can employ a specially configured linkage.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
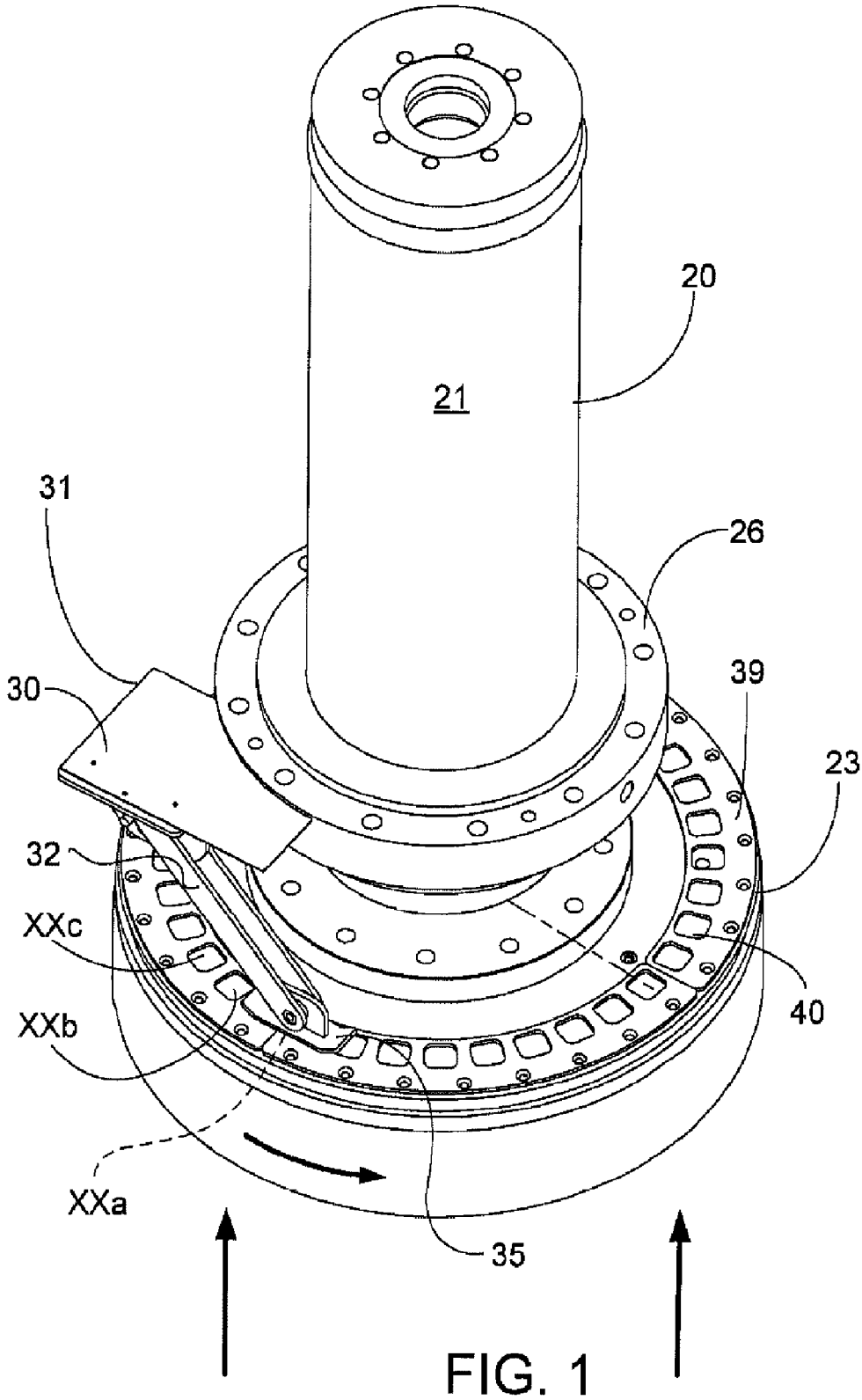
FIG. 1 is a partial perspective view of the preferred embodiment of the apparatus of the present invention.
Figure 2:
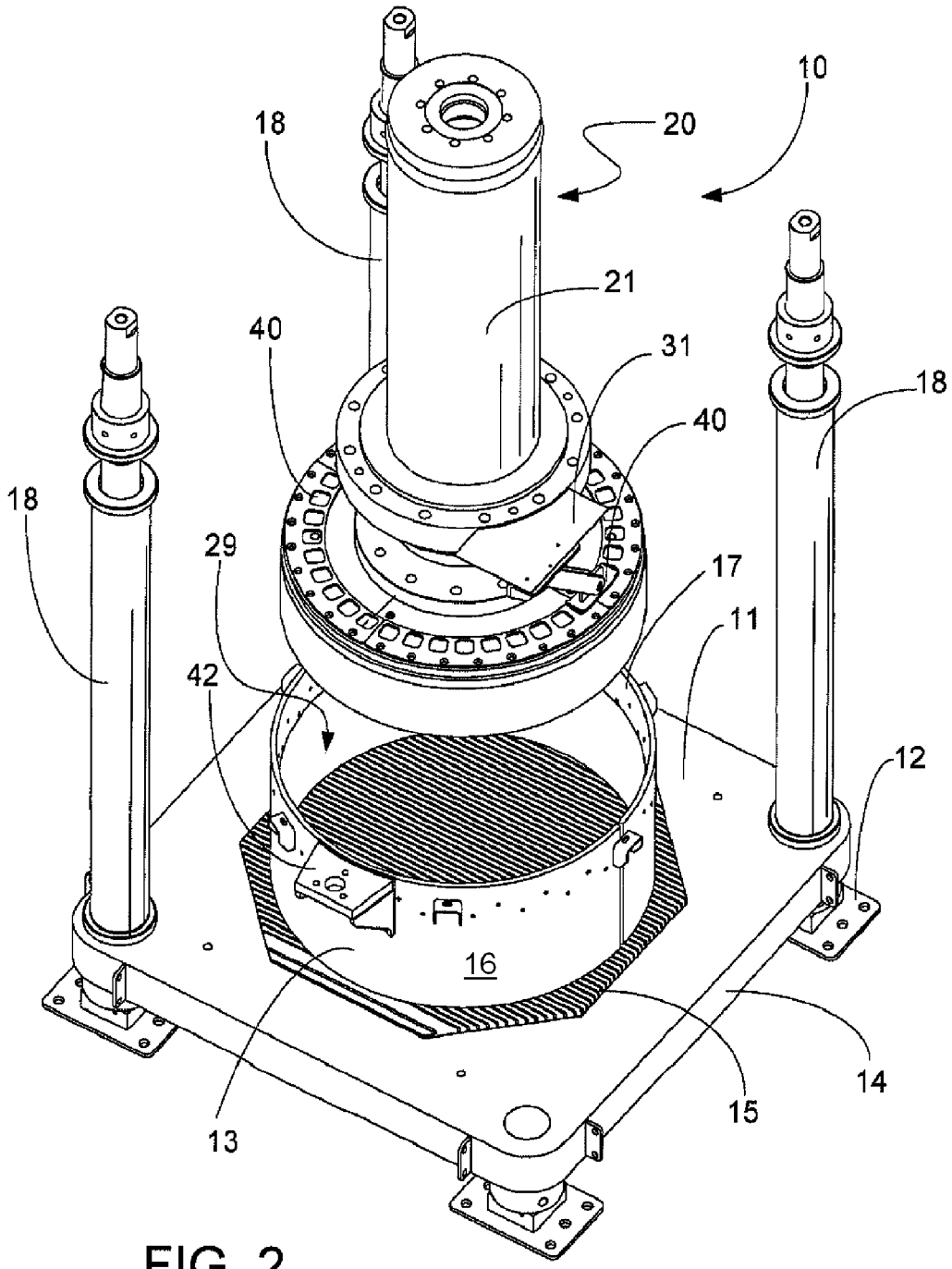
FIG. 2 is a perspective view of the preferred embodiment of the apparatus of the present invention showing the press in an upper position.

FIGS. 1-9 show that the preferred embodiment of the apparatus of the present invention designated generally by the numeral 10. Laundry press apparatus 10 employs a frame 11. Frame 11 can rest upon a reinforced concrete floor or other support surface. Frame 11 thus provides a plurality of feet 12 that engage in underlying support surface or floor. Frame 11 supports a receptacle or can 13 that received a batch of laundry to be pressed. Frame 11 can provide a horizontally extending base 14 of welded steel construction as an example.

Base 14 has a perforated section or grating 15 that allows water to drain through base 14 such as occurs when laundry articles, fabric articles or clothing are pressed to remove liquid therefrom. Receptacle/can 13 has a side wall 16 that surrounds interior 17. Open top 29 is receptive of a batch of laundry articles or fabric articles to be pressed.

Figure 9:
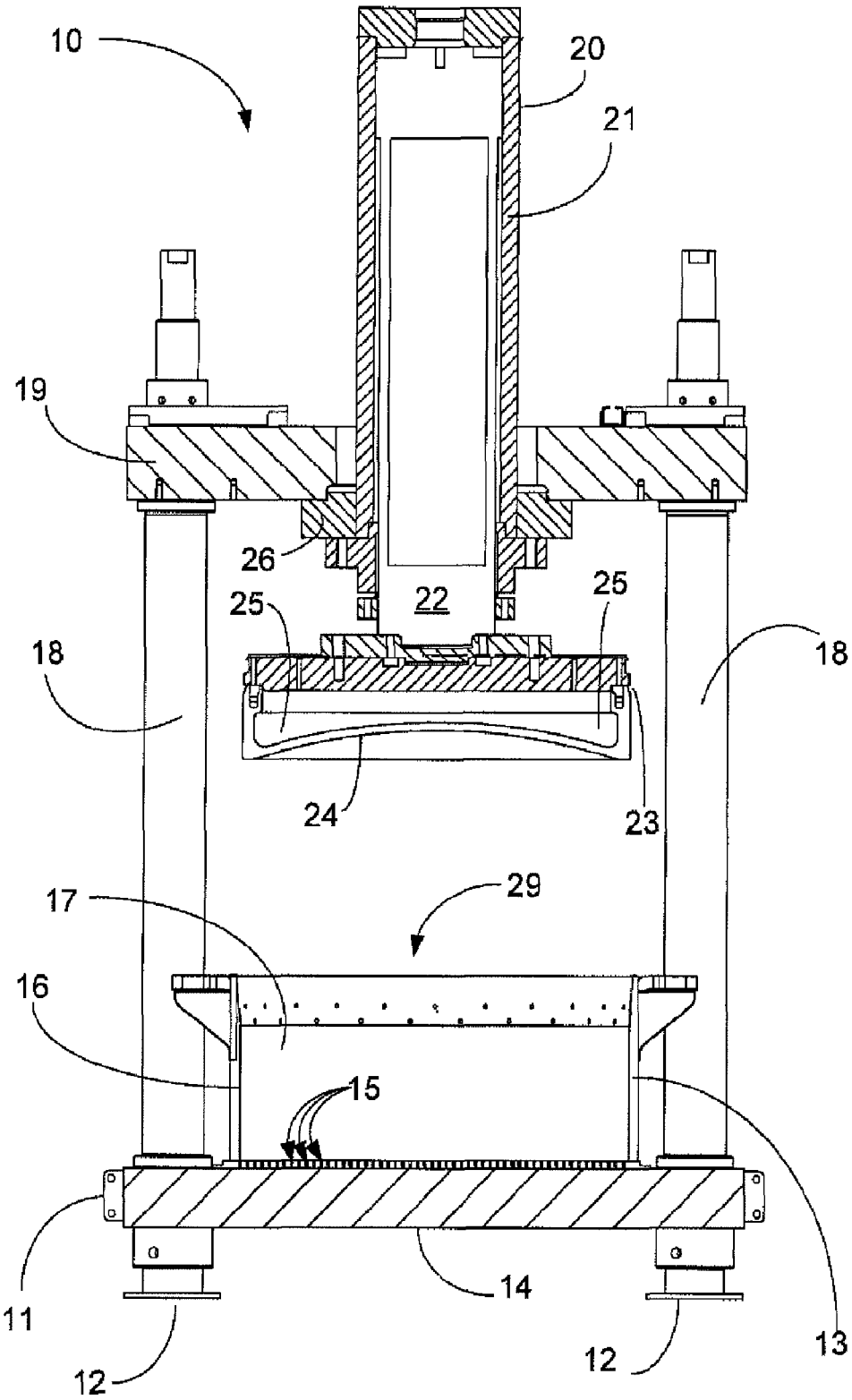
FIG. 9 is a sectional elevation view of the preferred embodiment of the apparatus of the present invention.
Figure 10:
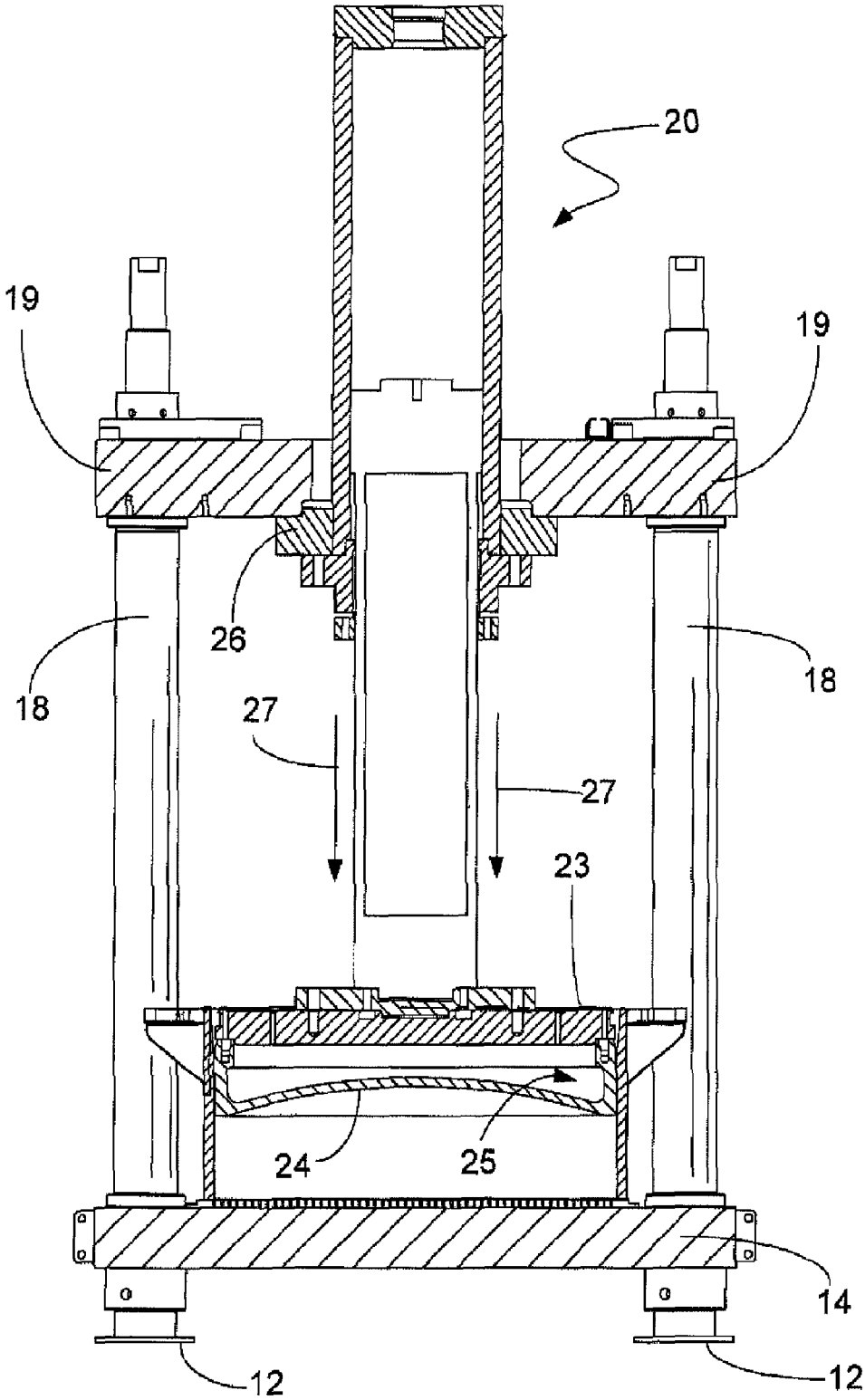
FIG. 10 is a sectional elevation view of the preferred embodiment of the apparatus of the present invention showing the press and diaphragm in a lowered position.

A plurality of supports (such as columns) 18 offer support or hold horizontal member 19 at an elevated position (see FIGS. 9-10). Ram 20 is mounted on upper support/horizontal member 19 as shown. Ram 20 provides a cylinder 21 and pushrod 22. At the lower end portion of pushrod 22 is attached head 23.

Head 23 carries a flexible diaphragm 24. A cavity 25 is provided on the upper surface of diaphragm 24. The cavity 25 is a cavity that is pressurized when clothing or fabric articles are to be pressed. The cavity 25 can be filled with fluid under pressure. Generally speaking, a liquid extracting apparatus for removing excess water from laundry articles using fluid pressure and a diaphragm that is inflated by a fluid pressure is known. Such a liquid extracting device is shown and described in U.S. Pat. No. 4,452,056 issued to William C. Files and assigned to Assignee herein, Pellerin Milnor Corporation. The '056 patent is hereby incorporated herein by reference.

Figure 3:
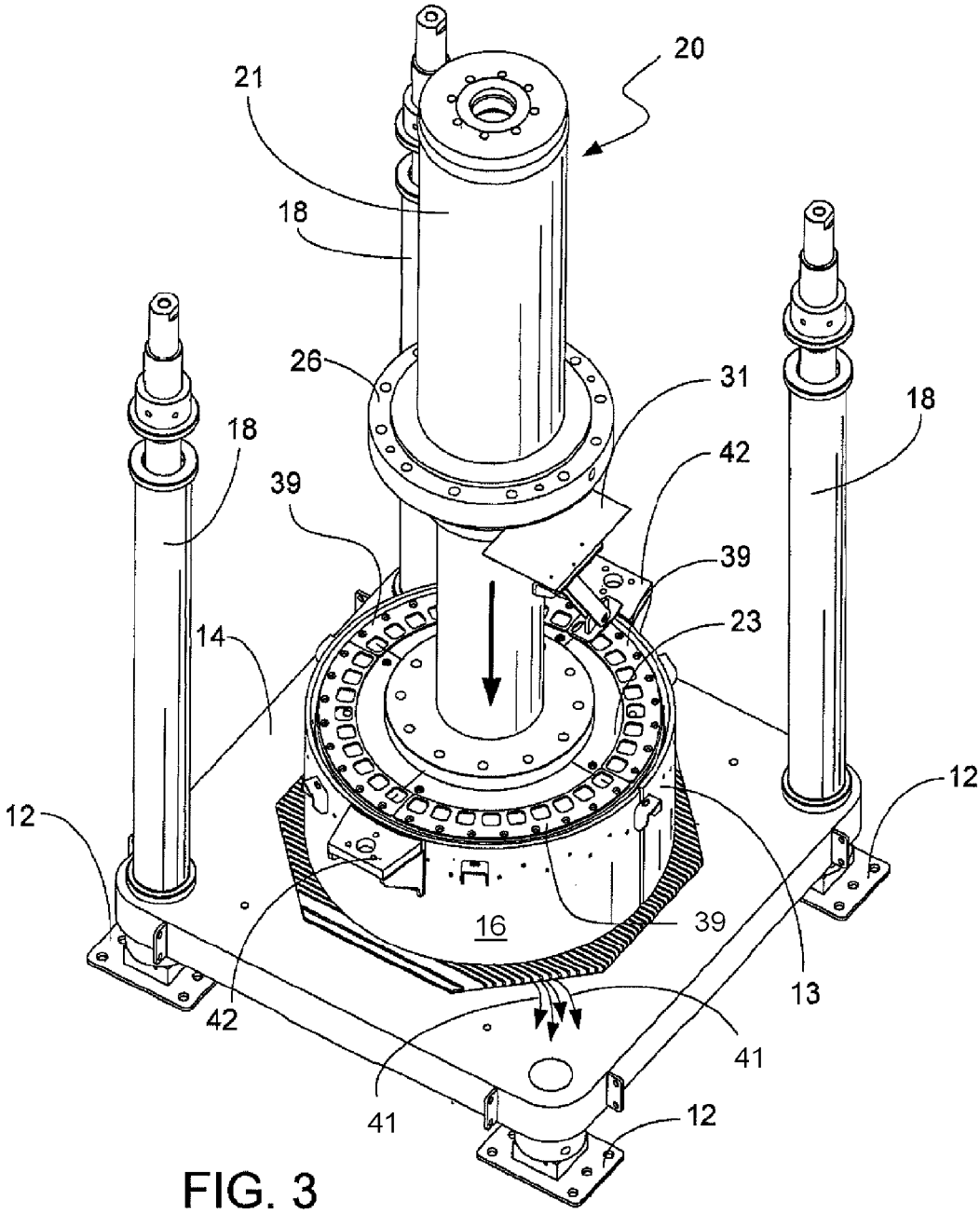
FIG. 3 is a perspective view of the preferred embodiment of the apparatus of the present invention showing the press in a lowered position.
Figure 4:
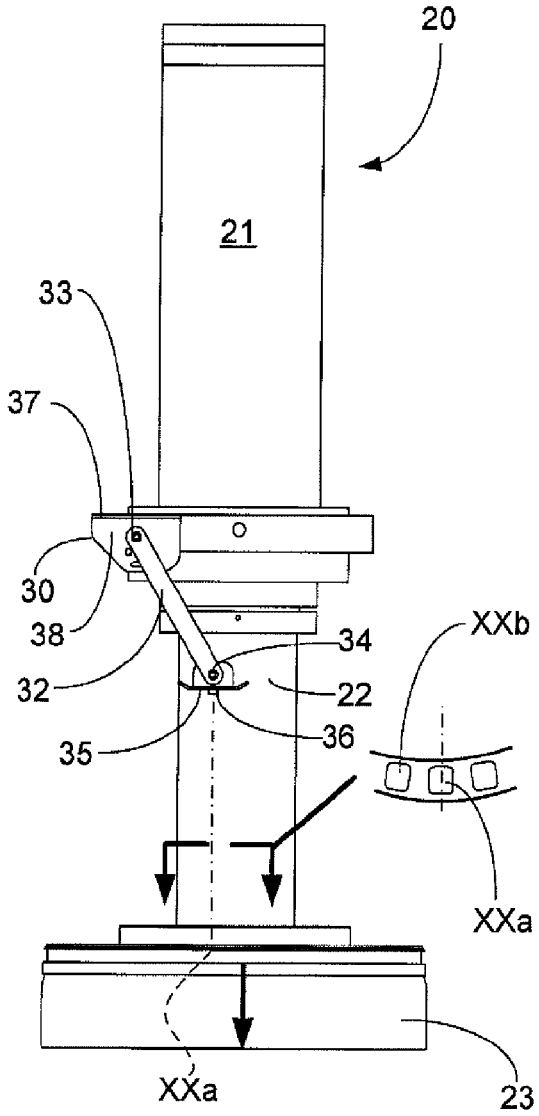
FIG. 4 is a fragmentary elevation view of the preferred embodiment of the apparatus of the present invention showing the press and diaphragm in a lowered position.

Fitting 26 (e.g. an annular fitting or annular flanges) connects ram 20 to upper support/horizontal member 19 as shown in FIG. 10. During use, head 23 is moved downwardly as illustrated by arrows 27 in FIG. 10 until it contacts a batch of laundry in can 13. Can or receptacle 13 has an open top 29 that is receptive of head 23. A lowered position of head 23 is shown in FIG. 10. An actuator or linkage 30 is used to rotate head 23 and thus diaphragm 24 after the batch of clothing contained in can or receptacle 13 have been pressed. This rotation of diaphragm 24 insures even wear to diaphragm 24 over time. The actuator/linkage 30 rotates head 23, pushrod 22 and diaphragm 24 a few degrees each time that the ram 20 cycles. Mounting plate 31 is attached to frame 11. Mounting plate 31 can be attached for example to fitting 26 as shown in FIG. 3. Mounting plate 31 can include horizontal flange or section 37 and vertical flange or section 38.

Actuator/linkage 30 employs arm 32. Arm 32 is pivotally attached at its end portions to mounting plate 31 and to lug plate 35. Pivotal connection 33 attaches arm 32 to vertical flange 38 of mounting plate 31. Pivotal connection 34 attaches arm 32 to lug plate 35.

Lug 36 extends downwardly from lug plate 35. The lug 36 is sized and shaped to form an interlocking connection with openings 40 of radial sprocket or curved plate sections 39. In the drawings, the arrows XXa, XXb, XXc show the positions of the first, second and third openings 40 that are engaged in sequence by lug 36 of lug plate 35. In FIG. 1, there can be for example thirty-six openings 40. In this fashion, the diaphragm 24, head 23 and pushrod 22 each move a measure of 10° with each cycle of the press 20. Each opening 40 can be slightly larger than the lug 36 to provide some play.

A "cycle" of press 20 occurs as follows. Head 23 moves downwardly from an elevated position (shown in FIGS. 2 and 9) as indicated by arrows 27 in FIG. 10. The head 23 and more particularly the diaphragm 24 contacts a wetted batch of laundry to be pressed. The lowered position wherein the head 23 and its diaphragm 24 contact the batch of laundry is seen in FIGS. 3 and 10. Fluid pressure in space 25 forces diaphragm 24 downwardly to press fluid from the batch of laundry. Such fluid is discharged from the batch of laundry as illustrated by arrows 41 in FIG. 3. The head 23 then elevates toward linkage 30 (see FIG. 5).

Figure 5:
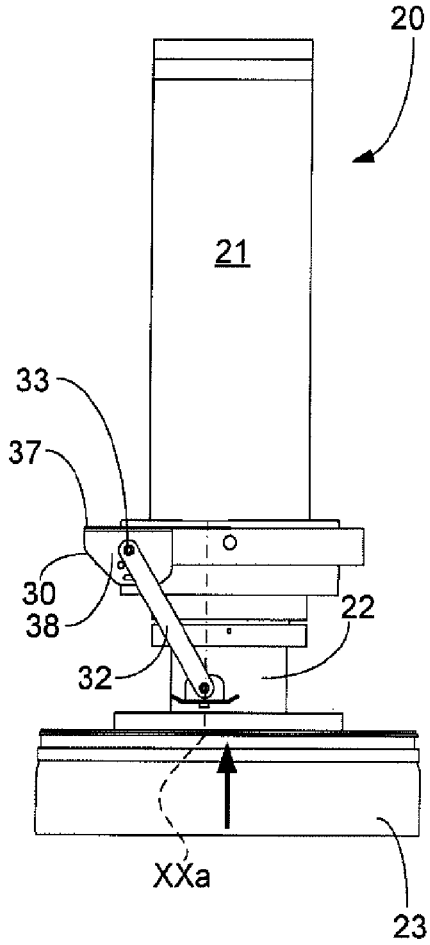
FIG. 5 is a fragmentary elevation view of the preferred embodiment of the apparatus of the present invention showing the diaphragm and press in an upper position.
Figure 6:
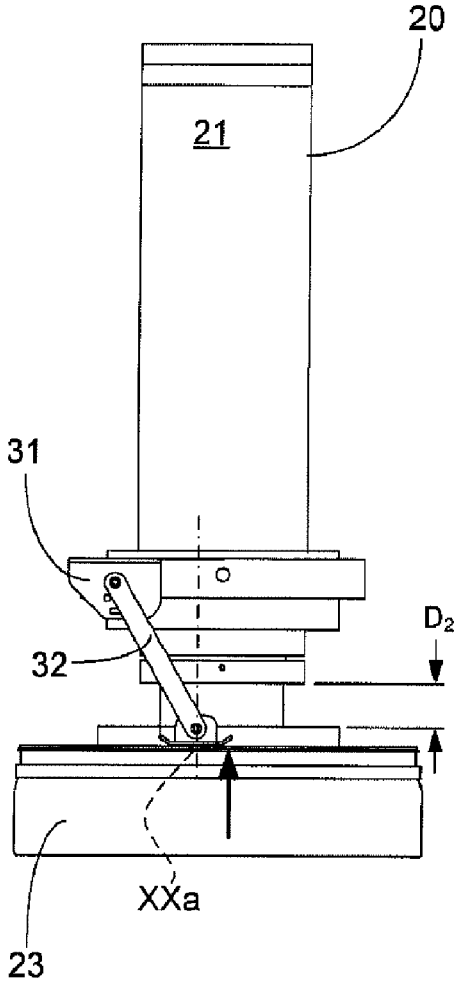
FIG. 6 is a fragmentary elevation view of the preferred embodiment of the apparatus of the present invention.
Figure 7:
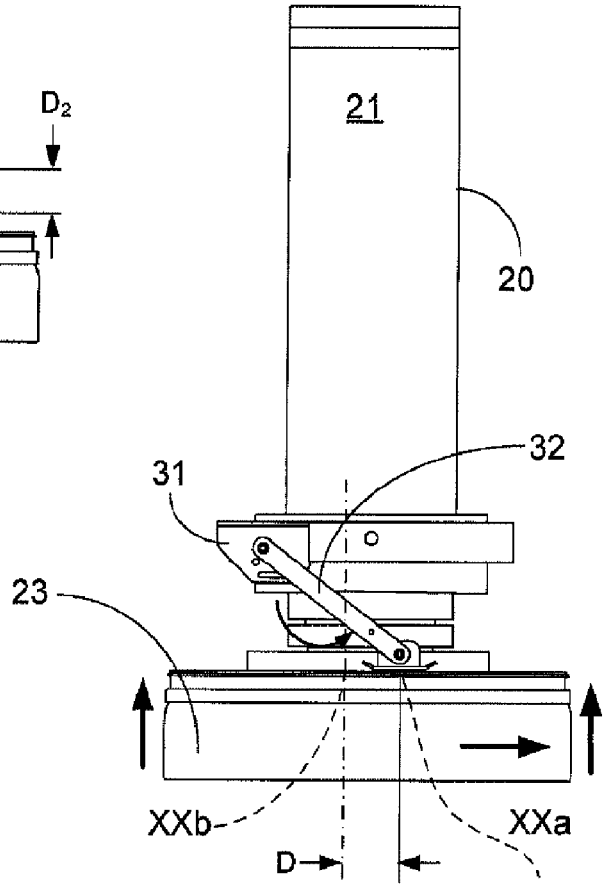
FIG. 7 is another fragmentary elevation view of the preferred embodiment of the apparatus of the present invention.
Figure 8:
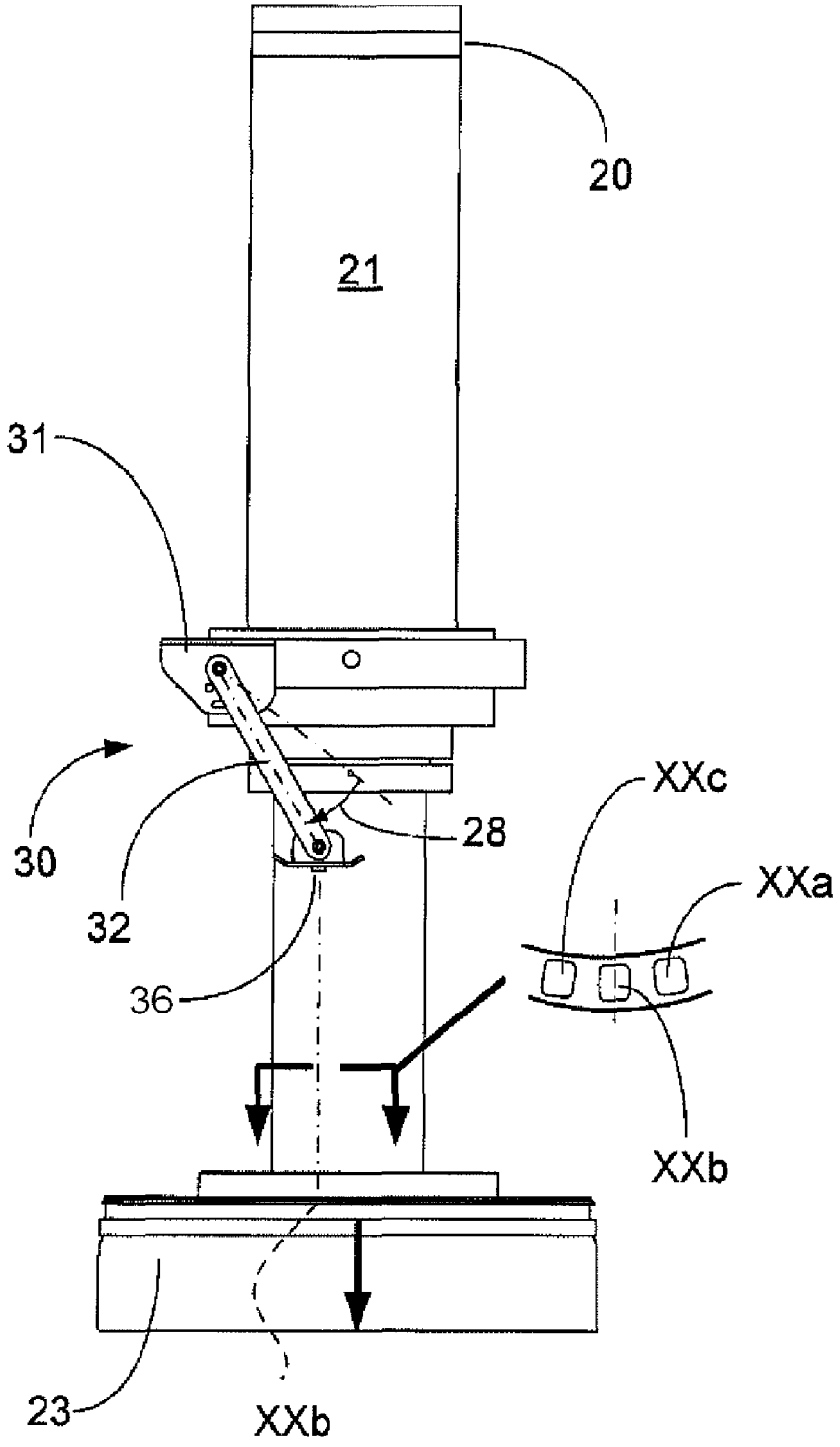
FIG. 8 is a fragmentary elevation view of the preferred embodiment of the apparatus of the present invention.

In FIG. 5, head 23 contacts linkage 30. Lug 36 then engages and interlocks with an opening 40 of curved plate section 39. Continued upward movement of head 23 rotates arm 32 from the position in FIG. 6 to the position of FIG. 7, rotating head 23, diaphragm 24 and pushrod 22 a small measure (for example ten degrees). The arm 32 rotates a measure of an acute angle represented by the arrow 28 in FIG. 8. FIG. 8 shows initiation of another cycle as the ram 20 sends its head 23 downwardly to engage and press the next batch of laundry.

Each can or receptacle 13 can be provided with lifting eyes 42 for transporting the can or receptacle 13 to and from the ram 20. The first cycle engages lug 36 into an opening 40 at position XXa. The second cycle engages lug 36 into an opening 40 at position XXb. The third cycle engages lug 36 into an opening 40 at position XXc and so forth.

The following is a list of parts and materials suitable for use in the present invention.

PARTS LIST

| Part Number | Description |
|---|---|
| 10 | laundry press apparatus |
| 11 | frame |
| 12 | foot |
| 13 | receiving vessel/receptacle/can |
| 14 | base |
| 15 | grating/perforated section |
| 16 | side wall |
| 17 | interior |
| 18 | column/support |
| 19 | upper support/horizontal member |
| 20 | ram/press |
| 21 | cylinder |
| 22 | pushrod |
| 23 | head |
| 24 | diaphragm |
| 25 | cavity |
| 26 | fitting |
| 27 | arrow |
| 28 | arrow |
| 29 | open top |
| 30 | actuator/linkage |
| 31 | mounting plate |
| 32 | arm |
| 33 | pivotal connection |
| 34 | pivotal connection |
| 35 | lug plate |
| 36 | lug |
| 37 | horizontal flange |
| 38 | vertical flange |
| 39 | radial sprocket/curved plate section |
| 40 | opening/socket |
| 41 | arrow |
| 42 | lifting eye |
| XXa | position |
| XXb | position |
| XXc | position |

All measurements disclosed herein are at standard temperature and pressure, at sea level on Earth, unless indicated otherwise. All materials used or intended to be used in a human being are biocompatible, unless indicated otherwise.

The foregoing embodiments are presented by way of example only; the scope of the present invention is to be limited only by the following claims.

The invention claimed is:

1. A method for pressing fluid from fabric laundry articles, comprising the steps of:

a) filling a receiving vessel with a first batch of fabric laundry articles that are wetted with fluid;

b) compressing the fabric laundry articles with a press to discharge fluid from the articles;

c) wherein in step "b" the press includes a diaphragm that flexibly conforms to an upper surface portion of the first batch of step "a";

d) rotating the diaphragm after step "b" with an arm that has a lug which engages a socket of a radial sprocket on the press;

e) changing the elevation of the diaphragm and press before step "f";

f) discharging the first batch of articles from the receiving vessel;

g) filling the receiving vessel with a second batch of articles;

h) pressing the second batch of articles after steps "d" through "g".

2. The method of claim 1 wherein the press includes a pushrod that is movable between pressing and non-pressing positions.

3. The method of claim 1 wherein the press travels between an upper non-pressing position and a lower pressing position.

4. The method of claim 1 wherein the press travels between an upper non-pressing position and a lower pressing position and wherein the diaphragm is rotated next to the upper non-pressing position.

5. The method of claim 1 wherein the arm pivots an amount that forms an acute angle.

6. The method of claim 5 wherein the press has a plurality of circumferentially spaced receptacles and the arm engages a receptacle during step "d", the receptacles being spaced less than about thirty degrees apart.

7. The method of claim 6 wherein the receptacles are spaced about ten degrees apart.

8. The method of claim 6 wherein the press includes a disk and the receptacles are arranged in a curved path about the periphery of the disk.

9. The method of claim 7 wherein the disk is generally circular and the receptacles are arranged in a curved path about the periphery of the disk.

10. A press for pressing batches of fabric articles to remove excess fluid therefrom, comprising:

a) a vessel having an interior that is configured to receive a batch of fabric articles therein;

b) a press having a ram and a disk supported at the lower end portion of the ram;

c) the disk having a lower surface that supports a diaphragm;

d) wherein the diaphragm is positioned to engage an upper surface portion of the batch of articles that are contained within the vessel interior;

e) the ram and the disk being movable between upper and lower positions, the lower position being a pressing position that engages the diaphragm with the fabric articles;

f) a rotator that rotates the diaphragm when the ram and the disk elevate toward the upper position.

11. The press as claimed in claim 10, further wherein said diaphragm is subjected to a pressure medium.

12. The press as claimed in claim 10, wherein the disk penetrates into said vessel and presses dry the batch of articles.

13. A method for pressing fluid from laundry articles, comprising the steps of:

a) filling a receiving vessel with a first batch of fabric articles that are wetted with fluid;

b) compressing the fabric articles with a press to discharge fluid from the articles;

c) wherein in step "b" the press includes a flexible diaphragm that conforms to an upper surface portion of the batch of step "a";

d) rotating the diaphragm after step "b" with a linkage that rotates the diaphragm responsive to an elevation of the press, said linkage including a radial sprocket;

e) changing the elevation of the diaphragm and the press before step "f";

f) discharging the first batch of articles from the receiving vessel;

g) filling the receiving vessel with a second batch of articles; and h) pressing the second batch of articles after steps "d" through "g".

14. The method of claim 13 wherein the press includes a pushrod that is movable between pressing and non-pressing positions.

15. The method of claim 13 wherein the press travels between an upper non-pressing position and a lower pressing position.

16. The method of claim 13 wherein the press travels between an upper non-pressing position and a lower pressing position and wherein the diaphragm is rotated next to the upper non-pressing position.

17. The method of claim 13 wherein the press includes a disk that carries the diaphragm and wherein in step "d" a pushrod engages the press as the press approaches an upper non-pressing position, the pushrod engaging and rotating the disk as the disk travels upwardly.

18. The method of claim 17 wherein the disk has an upper surface with a plurality of receptacles and wherein the pushrod engages a receptacle during step "d".

19. The method of claim 18 wherein the disk has an upper surface with a plurality of openings and wherein the pushrod engages an opening during step "d".

20. The method of claim 18 wherein the disk is generally circular and the receptacles are arranged in a curved path about the periphery of the disk.

21. The method of claim 19 wherein the disk is generally circular and the openings are arranged in a curved path about the periphery of the disk.

22. A press for pressing batches of fabric articles to remove excess fluid therefrom, comprising:

a) a vessel having an interior that is configured to receive a batch of fabric articles therein;

b) a press having a ram and a disk supported at the lower end portion of the ram;

c) the disk having a lower surface that supports a diaphragm;

d) wherein the diaphragm is positioned to engage an upper surface portion of the batch of articles that are contained within the vessel interior;

e) the ram and the disk being movable between upper and lower positions, the lower position being a pressing position that engages the diaphragm with the fabric articles;

f) a rotator that rotates the diaphragm when the ram and disk elevate toward the upper position.

23. The press as claimed in claim 22, further wherein said diaphragm is subjected to a pressure medium.

24. The press as claimed in claim 22, wherein the disk penetrates into said vessel and presses dry the batch of articles.

* * * * *